US008769853B1

(12) United States Patent
LaRue

(10) Patent No.: US 8,769,853 B1
(45) Date of Patent: Jul. 8, 2014

(54) QUICK-DETATCHABLE HANDGUARD MECHANISM FOR FIREARMS

(71) Applicant: Mark C. LaRue, Leander, TX (US)

(72) Inventor: Mark C. LaRue, Leander, TX (US)

( * ) Notice: Subject to any disclaimer, the term of this patent is extended or adjusted under 35 U.S.C. 154(b) by 0 days.

(21) Appl. No.: 13/889,575

(22) Filed: May 8, 2013

(51) Int. Cl.
*F41C 23/00* (2006.01)
*F41C 23/16* (2006.01)

(52) U.S. Cl.
CPC ..... *F41C 23/16* (2013.01)
USPC ..... 42/71.01; 42/73; 42/75.03

(58) Field of Classification Search
CPC ..... F41A 5/28; F41A 13/12; F41C 23/16
USPC ..... 42/71.01, 73, 75.03
See application file for complete search history.

(56) References Cited

U.S. PATENT DOCUMENTS 1,892,259 A * 12/1932 Von Frommer ..... 42/71.01
2,390,522 A * 12/1945 Diffley ..... 42/75.01
4,536,982 A * 8/1985 Bredbury et al. ..... 42/71.01
5,826,363 A * 10/1998 Olson ..... 42/75.01
6,490,822 B1 * 12/2002 Swan ..... 42/71.01
6,671,990 B1 * 1/2004 Booth ..... 42/75.01
7,707,762 B1 * 5/2010 Swan ..... 42/85
8,046,949 B1 * 11/2011 Daniel ..... 42/75.02
8,051,595 B2 * 11/2011 Hochstrate et al. ..... 42/75.01
2006/0260169 A1 * 11/2006 Samson et al. ..... 42/72
2007/0261285 A1 * 11/2007 Troy ..... 42/75.03
2009/0013579 A1 * 1/2009 Fluhr ..... 42/71.01
2012/0036756 A1 * 2/2012 Brown ..... 42/71.01
2013/0047832 A1 * 2/2013 Hochstrate et al. ..... 89/191.01

* cited by examiner

*Primary Examiner* — Samir Abdosh
(74) *Attorney, Agent, or Firm* — James L. Jackson

(57) ABSTRACT

A detachable handguard for firearms having a receiver defining a handguard mounting flange. Clamp members have hook-like ends that engage the handguard mounting flange and are attached to clamp actuating levers that are pivotally mounted to the handguard. The clamp members are positioned in clamping engagement with the mounting flange and are pivoted to clamping positions to force the handguard into tight assembly with the receiver and to move the connection of the clamp members with the actuating levers over-center, thus causing the clamp actuating levers to remain at their clamping positions. Lock members secure the clamp actuating levers at their clamping positions.

14 Claims, 6 Drawing Sheets

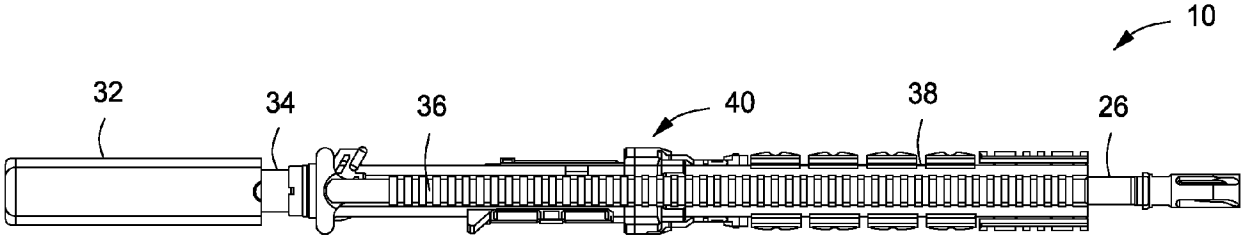
FIG. 3
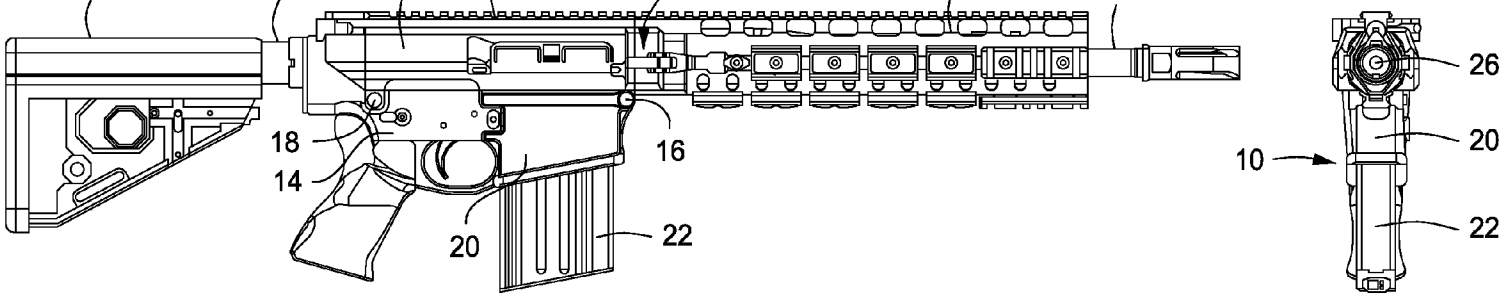
FIG. 1
FIG. 4

QUICK-DETATCHABLE HANDGUARD MECHANISM FOR FIREARMS

BACKGROUND OF THE INVENTION

1. Field of the Invention

The present invention relates generally to firearms such as tactical rifles having a receiver to which a handguard is mounted. This invention also concerns firearms, such as tactical rifles having a receiver/handguard mounting system that permits quick and simple assembly and disassembly of a handguard from a receiver, without necessitating the use of tools and without any risk of losing fasteners or other mounting components, especially with the disassembly process is accomplished during field conditions. More specifically, the present invention concerns firearms having a receiver/handguard mounting system having mounting structures on both the receiver and handguard and a clamp type latching mechanism that permits the handguard to be simply, efficiently and positively clamped and secured to the firearm receiver without necessitating the use of mounting tools.

2. Description of the Prior Art

Virtually all long guns, such as rifles, shotguns and the like have historically been provided with receivers containing a firing assembly, a barrel or barrels that are mounted to the receiver and a handguard that is engaged by a hand of a user to support and steady the barrel and other forward portions of a firearm. In the case of shotguns having a breach that is pivoted to an open position for loading and unloading one or more shotgun shells, a handguard is provided that is secured in place by a snap-actuating or latching handguard mounting system that facilitates handguard removal and replacement without any need for the use of tools. In most cases, the handguards of firearms with removable handguards have been composed of wood, with metal mounting and latching components.

In conjunction with military and law enforcement operations a number of tactical firearms, such as tactical rifles have been developed. For the most part, these types of firearms have been manufactured entirely of metal, with the receiver components composed of a hard and durable metal such as steel and the handguard components composed of a lighter weight metal such as aluminum or aluminum alloy. Stainless steel and titanium firearm components are also widely utilized for firearm manufacture. Typically, the handguard of a tactical firearm fits about the barrel and barrel mounting assembly of a firearm so that the handguard, being composed of a heat conducting metal, is isolated from the barrel so that the heat being liberated from the barrel is not passed directly to the handguard. In fact, the handguard typically defines a fairly large internal chamber having internal chamber surfaces that are widely spaced from the external surface of the barrel and the barrel mounting hardware. Moreover, the handguards of typical tactical rifles define many air circulation holes that readily permit convection induced circulation of air to move through the handguard, thus permitting air circulation cooling of the barrel. This is very important when the rifle is used for sustained rapid fire. The air circulation holes also minimize the volume and weight of the metal from which the handguard is composed, thus also minimizing the weight of the firearm and contributing to the efficiency of use and transportion by firearm users.

The firearm receivers and handguards of tactical rifles are also typically provided with mounting rails of the Picatinny or Weaver type, to permit sighting devices and other accessories to be supported along the length of a firearm.

SUMMARY OF THE INVENTION

It is a principal feature of the present invention to provide a novel firearm structure having a receiver and handguard that are each designed for releasable mounting, thus permitting a handguard to be releasably mounted to the receiver for ease and efficiency of assembly and disassembly even under field conditions;

It is another feature of the present invention to provide a novel firearm mechanism having a receiver and handguard that are each designed for releasable mounting and having one or more lever actuated clamp mechanisms that facilitate simple and efficient releasable mounting of a handguard to the receiver of the firearm;

It is an even further feature of the present invention to provide a novel firearm mechanism having a receiver and handguard each having a mounting structure and having lever actuated clamp mechanisms that are capable of manual operation by the firearm user Briefly, the various objects and features of the present invention are realized through the provision of a tactical firearm having an upper receiver that defines a forward end having a handguard mount structure and a barrel mount structure. The handguard mount structure has a mounting flange defining at least one and preferably two or more clamp receptacles and defines a forward facing handguard mount surface that is oriented in substantially perpendicular relation with the center-line of the barrel. The handguard defines an internal chamber receiving the barrel and gas tube assembly of the firearm in a manner ensuring that no part of the handguard is disposed in heat transferring engagement with the barrel. The barrel is engaged and positioned with respect to an externally threaded barrel mount structure of the upper receiver and is secured to the upper receiver by a barrel nut that is designed for driven engagement by a simple barrel nut tool.

The handguard member has a handguard retainer clamp assembly at its rearmost portion that is disposed for aligned engagement with the handguard mount structure of the upper receiver. The handguard retainer clamp assembly defines a generally planar rear surface that is oriented in substantially perpendicular relation with the center-line of the barrel and is disposed for face to face engagement with the forward facing handguard mount surface of the handguard mount structure of the upper receiver. The handguard retainer clamp assembly of the handguard has a clamp mounting flange that defines the generally planar rear surface and provides for pivotal mounting of two or more clamp lever members. To the clamp lever members are connected clamp members each having retainer hooks for clamping engagement with the clamp receptacles of the handguard mount structure of the upper receiver. The clamp lever members have toggle actuated relation with the clamp members, such that pivotal movement of the clamp lever members in one direction causes the clamp members to be drawn forwardly, thus causing the clamp members to force the handguard into tight and securely retained engagement with the handguard mount structure of the upper receiver.

Latch members are provided to secure the clamp lever members against pivotal releasing movement after the clamp members have been rotated to their maximum extend. For release of the handguard from the upper receiver, the latch members are first moved to their release positions and the clamp lever members are pivotally moved to their release positions, thus moving the clamp members to their release positions.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a side elevation view showing a tactical firearm embodying the principles of the present invention and showing the quick detachable handguard retainer mechanism in its closed and latched condition, securing the handguard firmly to the upper receiver;

FIG. 2 is an isometric illustration showing the tactical firearm of FIG. 1;

FIG. 3 is a top or plan view showing the tactical firearm of FIG. 1;

FIG. 4 is a front elevation view also showing the tactical firearm of FIG. 1;

FIG. 5 is an exploded isometric illustration showing the disassembled relation of the handguard and barrel assembly with respect to the upper receiver;

FIG. 6 is a partial top view showing the separated condition of the upper receiver and handguard and showing the pivotal lever actuated clamp mechanism at its release position;

FIG. 7 is a partial side elevation view showing the assembled condition of the upper receiver and handguard and showing the pivotal lever actuated clamp mechanism at its closed and locked position;

FIG. 8 is a partial top view showing the firearm mechanism and pivotal lever actuated clamp mechanism in the positions shown in FIG. 7; and FIG. 9 is a partial longitudinal section view showing portions of the upper receiver and handguard mechanism of a firearm and showing the pivotal lever actuated clamp mechanism of the present invention in the closed and locked condition thereof.

DETAILED DESCRIPTION OF PREFERRED EMBODIMENT

Figure 9:
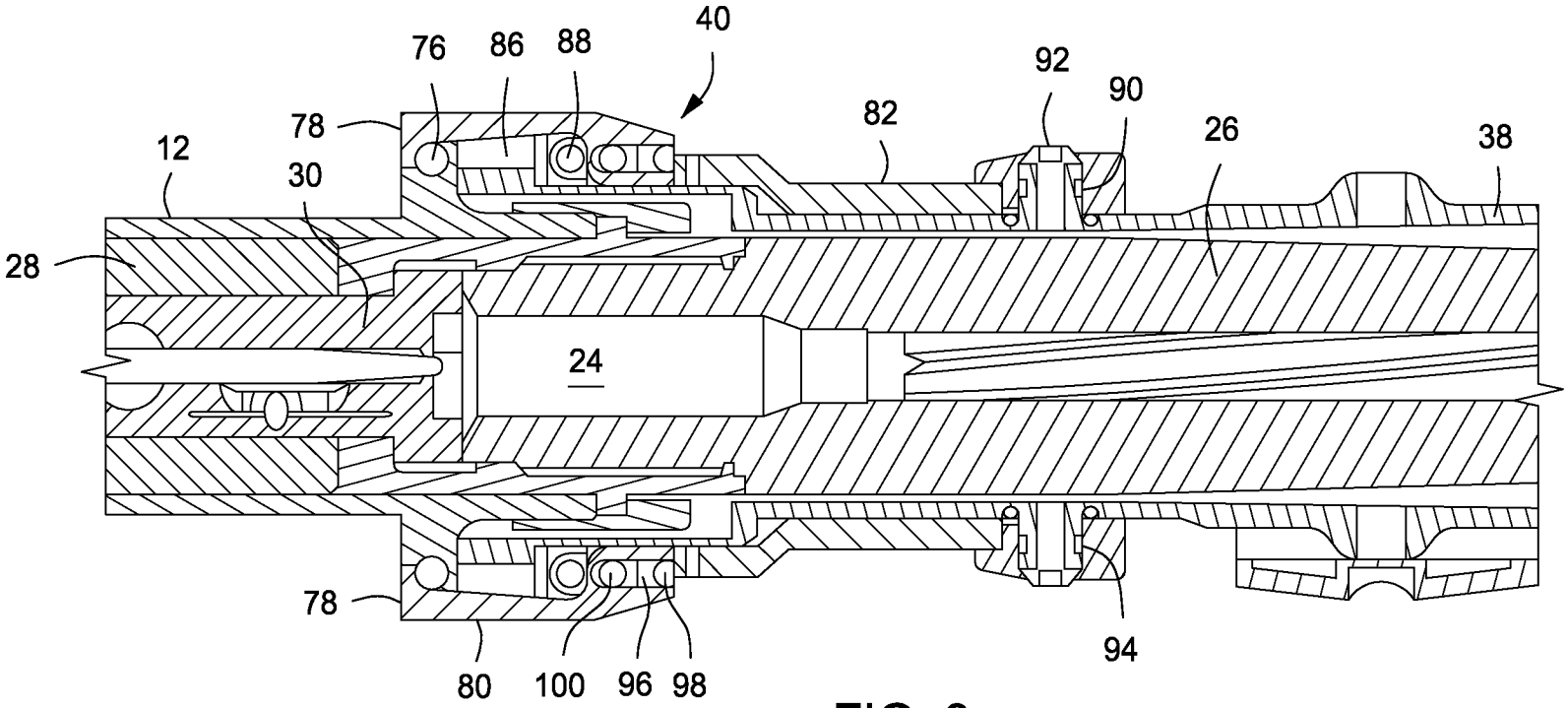

Referring now to the drawings and first to FIGS. 1-4, a firearm, such as a tactical rifle embodying the principles of the present invention is shown generally at 10, and incorporates an upper receiver 12 which is connected with a lower receiver 14 by means of a pivot 16 and by a locking pin mechanism 18. The lower receiver 14 defines a cartridge magazine receptacle 20 that receives a cartridge magazine 22 to position ammunition cartridges in serial fashion to be individually picked up and charged into the cartridge chamber 24 of a firearm barrel 26 by forward buffer spring energized reciprocating movement of a bolt carrier 28 and bolt mechanism 30 that are shown in FIG. 9.

A butt-stock mechanism 32 is adjustably mounted to the lower receiver 14 by means of a butt-stock mounting tube 34 that also serves as a receptacle for a spring resisting buffer mechanism that is driven rearward by the bolt carrier and bolt by cartridge gas energy that is conducted from the bore of the barrel upon firing a cartridge.

The upper receiver defines the rear section 36 of an accessory mounting rail that provides for releasable mounting of mechanical and optical sighting devices. A handguard mechanism 38 defines an internal chamber 39 through which the barrel member 26 extends and is releasably mounted to the upper receiver 12 by means of a quick detachable handguard retainer clamp assembly that is shown generally at 40. The handguard mechanism 38 also defines an accessory mount rail section 41, permitting the attachment of various types of accessories, such as light devices, laser sighting devices infrared detectors and the like to the firearm.

Figure 2:
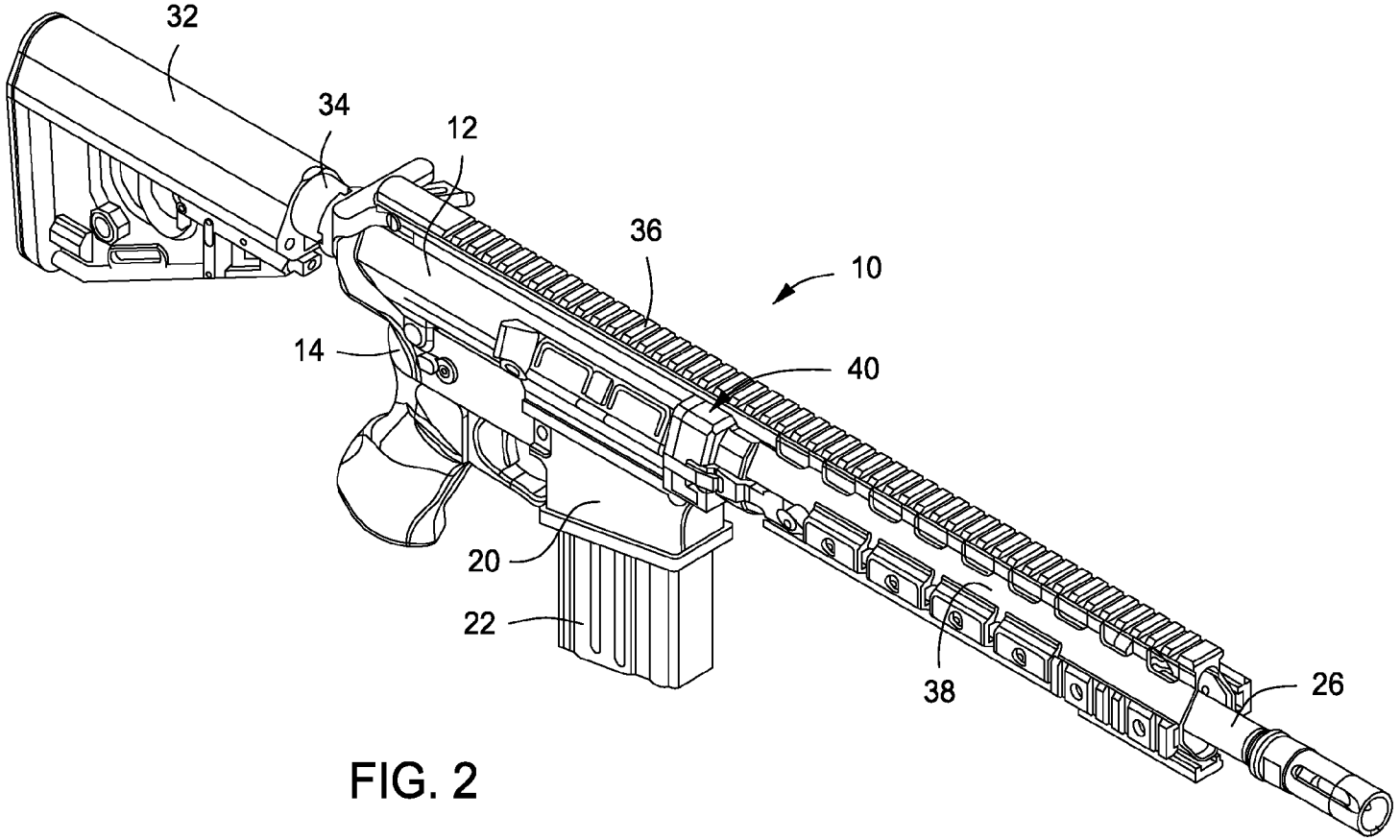
Figure 5:
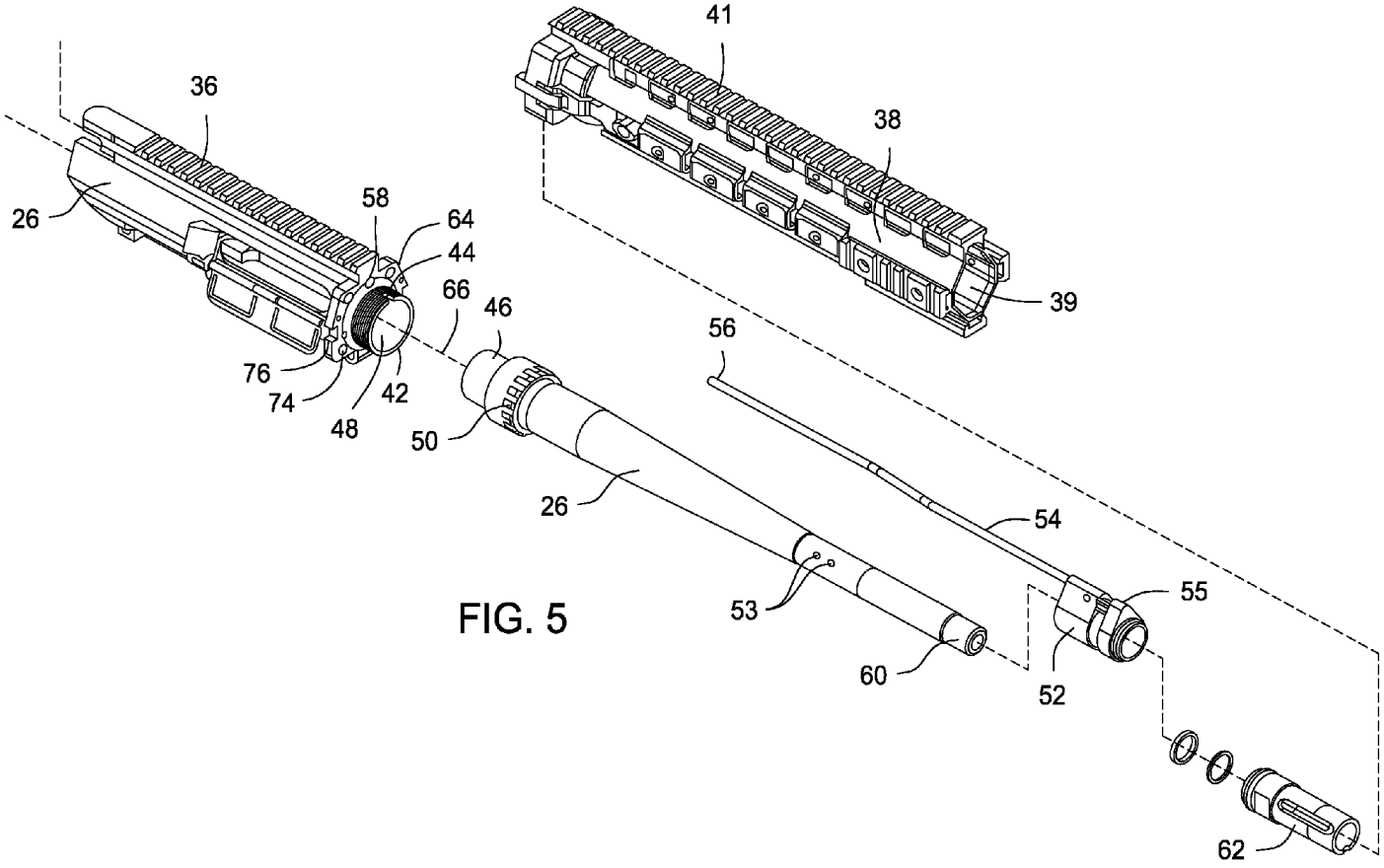

As best shown in the exploded isometric illustration of FIG. 5, the upper receiver 12 defines a forwardly projecting externally threaded barrel mount 42, defining a barrel alignment slot 44 that receives a barrel alignment pin of the barrel member 26 to establish precision alignment of the barrel with respect to the upper receiver. A rear end portion 46 of the barrel 26 is positioned within a barrel receptacle 48 of the barrel mount 42 when the barrel is completely seated within the barrel receptacle. A barrel nut 50 is threaded onto the forwardly projecting externally threaded barrel mount 42, and engages an annular shoulder of the barrel that is typically defined by a circular barrel retainer flange of the barrel or an attachment of the barrel. The barrel nut is securely tightened, by means of a simple barrel nut wrench, with a desired amount of torque force to secure the barrel in immoveable and properly oriented relation with the upper receiver.

The barrel assembly includes a barrel port block 52 that is mounted to the barrel 26 and communicates cartridge gas pressure from one or more gas ports 53 of the barrel that are in communication with the bore of the barrel. The gas ports 53 of the barrel are in communication with a gas tube 54 that extends from one or more gas passages of the barrel port block. If desired, the barrel port block 52 may include a port selector 55 for selective adjustment of the volume of cartridge gas that is permitted to enter the gas tube 54. An end portion 56 of the gas tube 54 is received within a gas tube receptacle 58 of the upper receiver to conduct the cartridge gas to an internal gas passage within the upper receiver for gas energized rearward movement actuation of the bolt and bolt carrier in response to the firing of a cartridge of ammunition. The forward end of the barrel 25 defines an externally threaded section 60 to which a typical flash hider assembly 62 is threadedly mounted.

At the forward end portion of the upper receiver 12 is provided a handguard mounting geometry 64 which may conveniently take the form of a handguard mounting boss or flange that is formed integrally with the upper receiver and is oriented in substantially perpendicular relation with the center-line 66 of the generally cylindrical barrel mount 42 and the center-line of the bore of the barrel 26. The handguard mounting geometry 64 also defines a substantially planar surface 68, best shown in FIG. 6 that is also oriented in substantially perpendicular relation with the center-line 66 of the generally cylindrical barrel mount 42 and is positioned for face to face engagement by a similar generally planar surface 70 of the handguard mechanism 38.

The substantially planar surfaces 68 and 70 are precision machined so that the handguard is precisely located with respect to the upper receiver when the surfaces 68 and 70 are secured in tight face to face relation. The handguard mechanism 38 is provided with a plurality of handguard location pins or projections 72, best shown in FIG. 6, which engage within corresponding handguard location receptacles 74, best shown in FIG. 5 for ensuring precision location of the rear portion of the handguard mechanism 38 with respect to the forward end portion of the upper receiver 12. While specific means for precision alignment of the handguard mechanism 38 with respect to the upper receiver 12, it should be borne in mind that this specific means for alignment is not intended to restrict the spirit and scope of the present invention, since other suitable means for precision alignment of the handguard and the upper receiver may be efficiently utilized.

Figure 7:
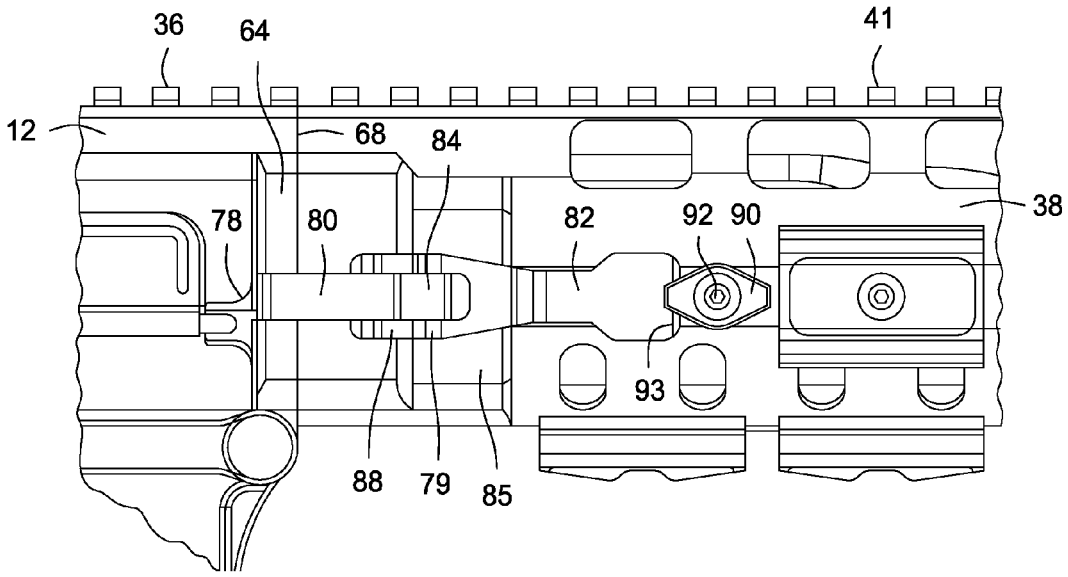
Figure 8:
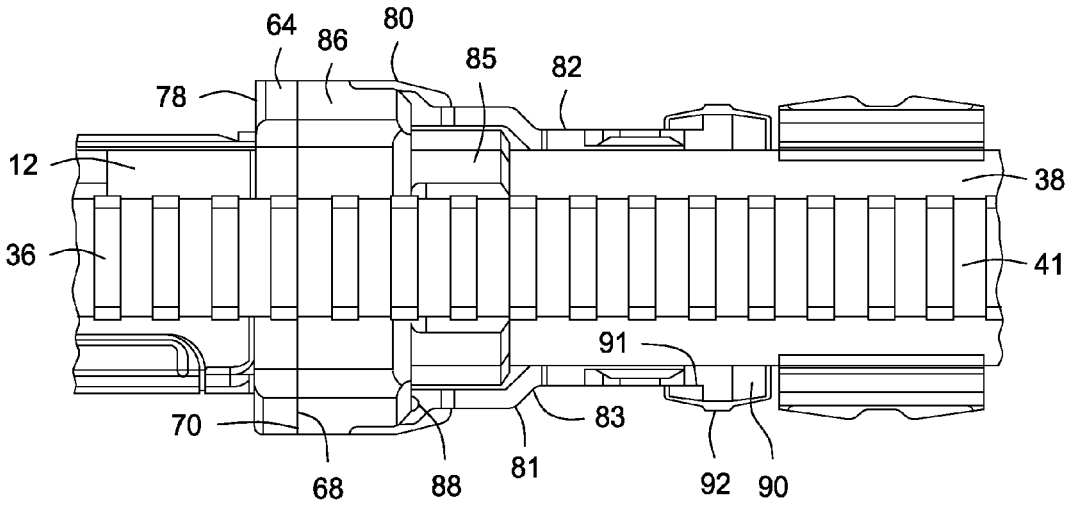

As shown in FIG. 5 and in greater detail in FIG. 9, the handguard mounting geometry 64 of the upper receiver 12 defines a pair of opposed clamp receptacles 76 that receive the hook-like rear extremities 78 of a pair of handguard retainer clamp members 80. The handguard retainer clamp members 80 are pivotally mounted intermediate the extremities of clamp actuating levers 82 by means of pivot members 79, shown best in FIG. 7. This remote or intermediate mounting arrangement ensures that the pivot connections of the retainer clamp members 80 will move over-center during closing or locking movement of the clamp actuating levers. This over-center positioning of the pivot connection causes the clamp actuating levers to have the tendency to remain at their closed and latched positions when completely closed, as shown in FIG. 9. There is no tendency for the clamp actuating levers to inadvertently move from their closed and latched conditions after having been moved to the positions shown in FIG. 9. Force must be applied to the clamp actuating levers to move them from their closed positions toward the open or release positions thereof. The rear end portions 84 of the clamp actuating lever members 82 are pivotally mounted to a clamp lever support structure 86 of the handguard mechanism by pivot members 88. The clamp lever support structure 86 is generally in the form of a boss or flange structure that is preferably integral with the handguard mechanism 38 and is oriented in substantially perpendicular relation with the center-line 66 of the barrel mount 42.

Figure 6:
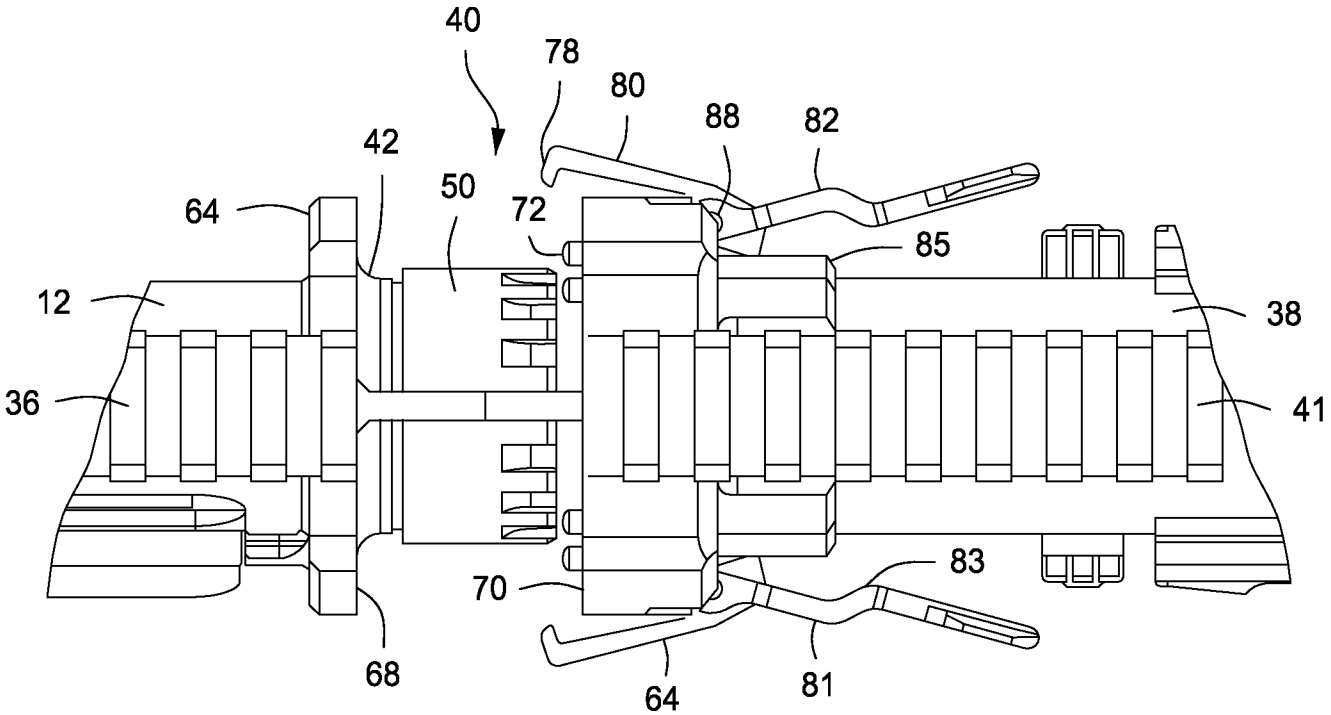

The clamp actuating levers 82 are pivotally moveable from open or release positions shown in FIG. 6 to closed and locked positions shown in FIG. 9, thus also positioning the retainer clamp members 80 at their open positions and closed and clamping positions, respectively. With the clamp actuating levers and retainer clamp members in the positions shown in FIG. 6, the handguard mechanism is moved to the left from the position of FIG. 6 to engage the alignment pins 72 of the handguard mechanism within the alignment receptacles 74 of the upper receiver 12 and positioning the substantially planar surface 70 of the handguard mechanism in face to face engagement with the substantially planar surface 68 of the upper receiver.

When this has been accomplished, the clamp actuating levers 82 are pivotally moved from the open and unlocked positions shown in FIG. 6 to the closed and locked positions shown in FIG. 9. During pivotal closing and locking movement of the clamp actuating levers 82 the retainer clamp members 80, being connected with the clamp actuating levers remote from the lever pivots 88, are pivoted downwardly toward their clamping positions and are simultaneously drawn forwardly, causing their hook-like extremities to establish clamping engagement with the clamp receptacles 76. Complete pivotal movement of the clamp actuating levers to the positions shown in FIG. 9 will urge the retainer clamp members 80 against the pair of opposed clamp receptacles 76, thus forcing the handguard mechanism tightly against the forward end of the upper receiver 12.

The pivotal clamp actuating levers have offset geometry 81 and 83 as shown in FIG. 6, permitting the clamping levers to clear external geometric features 85 of the handguard mechanism. By locating the actuating connection of the clamp actuating levers remote from the lever pivots, when the free extremities of the clamping levers have been moved to their clamping positions, as shown in FIG. 9, the forward ends of the retainer clamp members 80 will have moved over-center. This feature causes the retainer clamp members 80 and the clamp actuating levers 82 to remain in the clamping positions thereof, without any tendency to move from the clamping positions toward the release positions thereof. However, since firearms of this nature will often be carried in forested or brushy areas where the clamp actuating levers can be inadvertently moved from their clamping positions by being caught on twigs, vines and the like, it is desirable to latch the clamp actuating levers against inadvertent opening movement.

Latch members 90 are pivotally mounted to the handguard mechanism by mount screws 92 and bushings 94 and have a release position permitting pivotal movement of the clamp actuating levers from their closed and locked positions and a locked position securing the forward extremities of the clamp actuating levers at their closed and locked positions. The latch members are cut away as shown at 91, thus providing a latch recess within which the free extremities of the clamp actuating levers 82 are received to secure the clamp actuating levers against movement from their closed and latched positions. The free end portions of the clamp actuating levers are tapered as shown at 93 to facilitate movement of the latch members to the latched position shown in FIG. 7 These latch members prevent the clamp actuating levers from becoming inadvertently opened, thus preventing the handguard mechanism from becoming inadvertently loosened or separating from the upper receiver.

The retainer clamp members 80 are each provided with adjustment mechanisms 96 for adjusting the positions of the retainer clamp members with respect to the clamp actuating levers. The adjustment mechanisms 96 may conveniently take the form of externally threaded adjustment members 98 that are engaged within internally threaded receptacles and are adjustable by means of a simple tool such as a screw driver or other screw actuating tool. The threaded adjustment members may engage a spring urged detent, such as a ball dentent 98 to provide for controlled adjustment of the retainer clamp members 80. Typically, the adjustment mechanism will be set at the factory or during assembly by qualified personal for proper tightness of the handguard/upper receiver joint. However, in the event any looseness of the handguard is detected by the user of a firearm, the clamp actuating levers can be moved to their release positions and the adjustment mechanism can be adjusted by using a simple adjustment tool and rotating the threaded adjustment member. This feature will permit the firearm user to adjust the tightness of the clamping mechanism as needed.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A releasable handguard mount mechanism for firearms, comprising:

a firearm receiver defining a first handguard mount being a mounting flange defining a clamp receptacle;

a handguard mechanism having a second handguard mount disposed for assembly with said first handguard mount, said second handguard mount being a clamp lever support structure of said handguard mechanism;

a clamp member supported by said second handguard mount and having a clamping position retaining said second handguard mount in tight assembly with said first handguard mount and a release position permitting separation of said second handguard mount from said first handguard mount; and a clamp actuating lever member being pivotally mounted to said second handguard mount and disposed for actuation of said clamp member to said clamping position in response to movement of said clamp actuating lever member to a clamping position and for actuation of said clamp member to said release position upon movement of said clamp actuating lever member to a release position thereof.

2. The releasable handguard mount mechanism of claim 1, comprising:

said clamp member defining a hook-like extremity disposed for clamping and retaining engagement with said clamp receptacle; and said clamp actuating member, upon movement toward a clamping position applying a clamping force to said clamp member and forcing said second handguard mount into stabilized and securely retained relation with said first handguard mount.

3. The releasable handguard mount mechanism of claim 1, comprising:

said clamp member being pivotally mounted to said clamp actuating lever and having clamping and release positions determined by clamping and release positions of said clamp actuating lever.

4. The releasable handguard mount mechanism of claim 1, comprising:

a lever pivot member securing said clamp actuating lever to said clamp lever support structure; and said clamp member being pivotally connected to an intermediate portion of said clamp actuating lever remote from said lever pivot and having clamping and release positions determined by clamping and release positions of said clamp actuating lever.

5. The releasable handguard mount mechanism of claim 1, comprising:

a latch member being moveably mounted to said handguard mechanism and having a latching position restraining movement of said clamp actuating lever and a release position permitting movement of said clamp actuating lever from said latched position toward said release position thereof.

6. The releasable handguard mount mechanism of claim 1, comprising:

said first handguard mount defining a first substantially planar handguard orienting surface; and said second handguard mount defining a second substantially planar handguard orienting surface disposed in face to face engagement when said handguard mechanism is in clamped assembly with said firearm receiver.

7. The releasable handguard mount mechanism of claim 6, comprising:

said firearm having a barrel defining a center-line; and said first and second handguard orienting surfaces each being oriented in substantially perpendicular relation with said center-line.

8. The releasable handguard mount mechanism of claim 1, comprising:

said firearm having a barrel defining a center-line; and said first handguard mount having a first flange member on said firearm receiver and defining a first mount surface oriented in substantially perpendicular relation with said center-line; and said second handguard mount being located on said handguard mechanism and having a second flange member defining a second mount surface oriented in substantially perpendicular relation with said center-line, said first and second mount surfaces being disposed in engagement when said handguard mechanism is secured to said firearm receiver.

9. The releasable handguard mount mechanism of claim 1, comprising:

a plurality of alignment receptacles being defined by said first handguard mount; and a plurality of alignment pins being defined by said second handguard mount and being received by said plurality of alignment receptacles and establishing precision alignment of said handguard mechanism with respect to said firearm receiver.

10. A releasable handguard mount mechanism for firearms, comprising:

a firearm receiver having a mount flange at the forward end thereof defining a first handguard mount being a mounting flange defining a clamp receptacle;

a handguard mechanism having a handguard flange at the rear end thereof defining a second handguard mount of said handguard disposed for positioning engagement with said first handguard mount, said first and second handguard mounts each defining substantially planar handguard alignment surfaces each disposed in face to face handguard aligning engagement when said handguard mechanism is securely clamped to said firearm receiver;

a clamp member having a portion thereof substantially pivotally supported by said second handguard mount and having a hook-like clamping portion engaging said first handguard mount and retaining said second handguard mount in tight assembly with said first handguard mount and having a release position permitting separation of said second handguard mount from said first handguard mount; and a clamp actuating lever member being movably mounted to said second handguard mount and having actuating connection with said clamp member being moved to said clamping position in response to movement of said clamp actuating lever member to a clamping position and being moved to said release position upon movement of said clamp actuating lever member to a release position thereof.

11. The releasable handguard mount mechanism of claim 10, comprising:

said first handguard mount defining a clamp receptacle;

said hook-like portion of said clamp member disposed for clamping and retaining engagement with said clamp receptacle; and said clamp actuating lever, upon movement toward a clamping position applying a clamping force to said clamp member and forcing said second handguard mount into stabilized and securely retained relation with said first handguard mount.

12. The releasable handguard mount mechanism of claim 10, comprising:

said clamp member being pivotally mounted to said clamp actuating lever and having clamping and release positions determined by clamping and release positions of said clamp actuating lever.

13. The releasable handguard mount mechanism of claim 10, comprising:

a lever pivot member securing said clamp actuating lever to said clamp lever support structure; and said clamp member being pivotally connected to an intermediate portion of said clamp actuating lever remote from said lever pivot and having clamping and release positions determined by clamping and release positions of said clamp actuating lever.

14. The releasable handguard mount mechanism of claim 10, comprising:

said clamp actuating lever defining a free extremity and having a latching position positioning said free extremity in juxtaposed relation with said handguard mechanism; and a latch member being rotatably mounted to said handguard mechanism and having a latching position engaging said free extremity of said clamp actuating lever and restraining movement of said clamp actuating lever from said latched position, said latch member being rotatable to a lever release position permitting movement of said clamp actuating lever from said latched position toward said lever release position thereof.

* * * * *